United States Patent [19]

Ulfhielm

[11] 4,368,770

[45] Jan. 18, 1983

[54] DOOR, PREFERABLY FOR INDUSTRIAL BUILDINGS

[75] Inventor: Torbjorn Ulfhielm, Skelleftea, Sweden

[73] Assignee: UTEC AB of Fack, Sweden

[21] Appl. No.: 187,803

[22] Filed: Sep. 16, 1980

Related U.S. Application Data

[63] Continuation-in-part of Ser. No. 70,966, Aug. 30, 1979, which is a continuation of Ser. No. 894,158, Apr. 6, 1978, abandoned.

[51] Int. Cl.[3] ..... A47H 5/00

[52] U.S. Cl. ..... 160/84 R; 49/322

[58] Field of Search ..... 160/84 R, 193, 202; 49/28, 322

[56] References Cited

U.S. PATENT DOCUMENTS

| | | | |
|---|---|---|---|
| 2,007,552 | 7/1935 | Vetterlien | 160/202 |
| 2,568,808 | 9/1951 | Johanson | 49/28 |
| 4,131,830 | 12/1978 | Lee et al. | 49/28 |

FOREIGN PATENT DOCUMENTS

| | | | |
|---|---|---|---|
| 2611205 | 9/1977 | Fed. Rep. of Germany | 160/84 R |
| 2814345 | 10/1979 | Fed. Rep. of Germany | 160/84 R |
| 702462 | 4/1931 | France | 49/322 |
| 965141 | 7/1964 | United Kingdom | 160/84 R |
| 1394333 | 5/1975 | United Kingdom | 160/84 R |

*Primary Examiner*—Peter M. Caun

*Attorney, Agent, or Firm*—Fitch, Even, Tabin, Flannery & Welsh

[57] ABSTRACT

A door having a leaf of flexible material and held in suspension for raising and lowering within an opening has two lines attached to the lower portion of the door leaf, one line at each of its ends. The lines are also connected to a hoist means. The ends of the door leaf are guided in U-shaped forms having lateral flanges, the flanges being attached to the vertical defining surfaces of the door opening and each form carries one of the lines that extends to the hoist means. Each line is connected to its respective end of the door leaf by an intermediate release and lock means which responds to a predetermined decrease in load on the respective line to lock and hold fast the door leaf against the lateral flanges of the respective U-shaped form in any position along the door's vertical path of movement.

5 Claims, 6 Drawing Figures

STOP
UP
DOWN
LS
OL
SS1
SS2
UP COIL
DOWN COIL
L1
L2

DOOR, PREFERABLY FOR INDUSTRIAL BUILDINGS

This is a continuation-in-part of application Ser. No. 70,966, filed Aug. 30, 1979, which in turn is a continuation of application Ser. No. 894,158, filed Apr. 6, 1978, now abandoned.

This invention relates to a door, preferably for industrial buildings, and of the type having the door leaf suspended by means of at least two lines, such as ropes or the like, which are attached to the lower portion of the door leaf and connected to a hoist device. Its ends are guided in guide bars attached to the vertical defining surfaces of the door opening. The invention, more precisely, has the object of producing in such a door a release and lock device for permitting the raising and lowering of the door leaf for the opening and closing of the door, which device is simpler and safer than known devices and, in addition, is of such a nature as to hold fast the door in position and prevent the door leaf from collapsing when the load on any one of the lines carrying the door leaf drops below a predetermined value adjusted to the dead load of the door leaf.

This object is achieved by the device according to the invention having the characteristic features defined in the attached claims.

The invention is described in greater detail in the following, with reference to the accompanying drawings, in which.

Figures 1, 2, 3, 6:
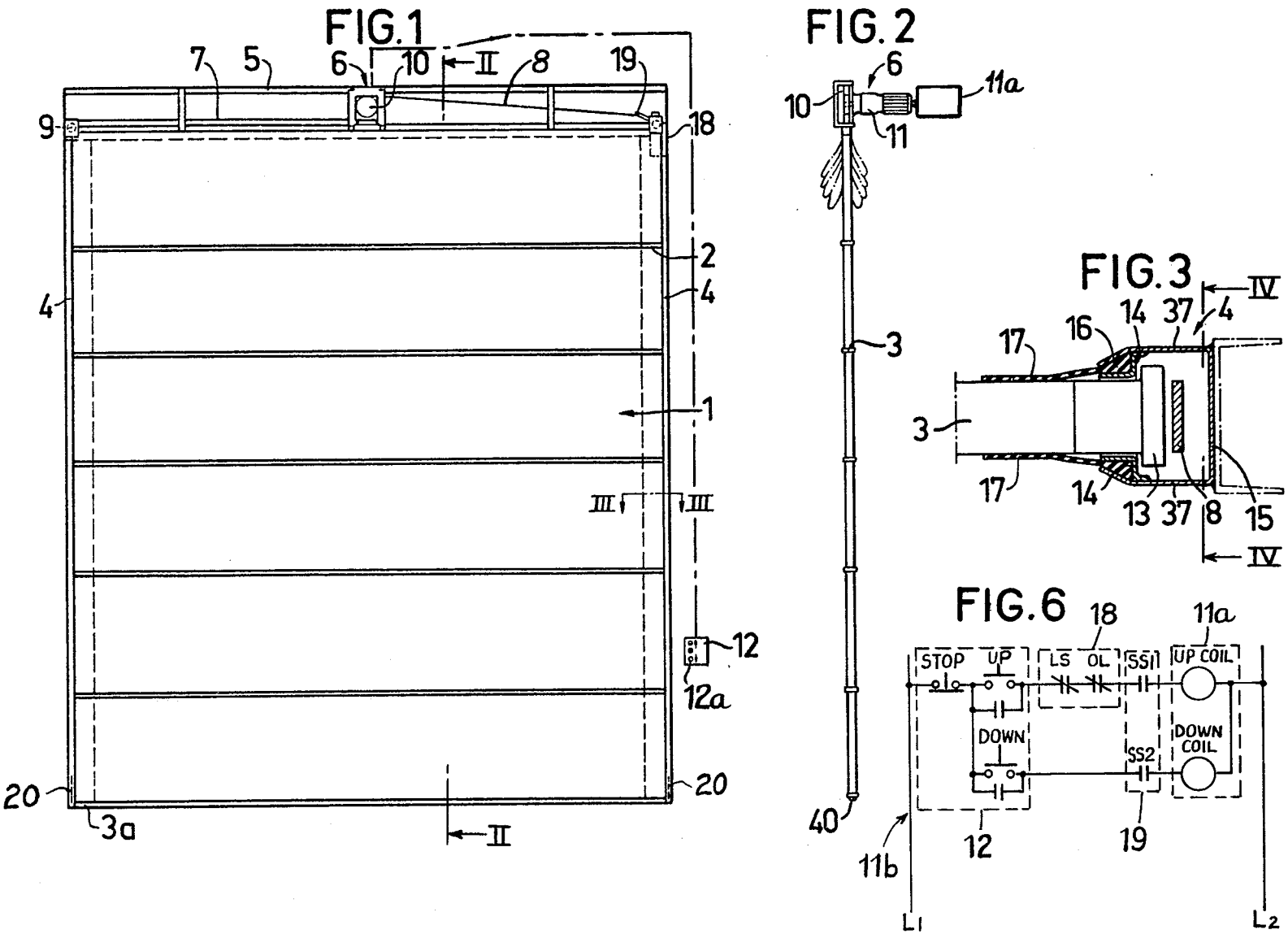
FIG. 1 is a front view of a door provided with the device according to the invention and in closed position.
FIG. 2 is a vertical section through the door along the line II—II in FIG. 1 and schematically showing the open position of the door by broken lines.
FIG. 3 is a section along the line III—III in FIG. 1.
FIG. 6 is a schematic of certain portions of an elementary electrical operating circuit for a hoist means usable in the device of FIG. 1.

Referring to the drawings, 1 designates generally the door leaf of a door, one or both surfaces of which consist of cloth or a flexible material. The door further includes a plurality of rigid cross-members 3 of mutually spaced relationship and of external strips 2 connected to the cloth, which cross-members at their ends are guided in substantially U-shaped guide bars 4 attached to the vertical defining surfaces of a door opening. The upper portion of the door leaf 1 is suspended at a door box 5 attached to the upper horizontal defining surface of the door opening, which box includes a hoist means 6 with lines, such as ropes, strings 7, 8 or the like, which are connected to the lower cross-member 3*a* of the door leaf and by means of which along with the hoist means 6, the door leaf can be hoisted to the position indicated in FIG. 2 by broken lines and can be lowered to the position indicated in FIGS. 1 and 2 by fully drawn lines for opening and closing the door, respectively.

The two lines 7 and 8 according to the invention are attached each to one end of the lower cross-member 3*a* of the door leaf and from there extend within the respective guide bar 4 in the upward direction to a guide wheel 9 in the door box and to a drum 10, common to both lines. The drum 10 is included in the hoist means and receives the lines 7 and 8 in an under-and-over manner respectively to wind and unwind the lines with respect to the drum as shown in FIG. 1.

The hoist means 6 of the illustrated embodiment comprises in addition to the drum an electrically operated, self-locking toothed gear 11 which drives the drum. The gear 11 is driven by a motor 11*a* which is connected to a power circuit 11*b* of suitable voltage and which is controlled from a coupling and control box 12 comprising, among other things, control switches 12*a* for "UP" and "DOWN" movement and "STOP". The lines 7 and 8, thus, are located protected within the guide bars 4. In order to prevent the door leaf 1 from damaging the lines by the ends of its cross-members upon its lateral movement, at least some of the cross-members, and preferably all of them, are provided at their ends with end stop members 13, which in co-operation with stop members 14 provided in the guide bars limit the movement of the door leaf in the lateral direction to such an extent that the end stop members 13 never can come closer to a wall 15 of the guide bars that is face to face with each of the vertical defining surfaces of the opening than a distance which is greater than the line thickness. In the embodiment shown, the stop members 14 include the rear surface of each of holding bars 16 for sealing strips 17 provided on each side of the door leaf 1 and extending over the entire height of the door opening.

To open the door, the gear 11 is rotated in such a direction that the lines 7 and 8 are wound on the drum 10 to thereby lift the lowermost cross-member 3*a* of the door leaf. During the continued lifting movement, the cross-members 3 are stacked one upon the other and the flexible material of the panels or leafs are folded together symmetrically as illustrated by the broken lines. The upper position of the door leaf is determined by stop means in the form of upper limit position units 18 located on each side of the door. These units include a so-called interlocking limit switch which is actuated by the upper surface of the upper cross-member or by another suitable means connected therewith to interrupt the electrical current from the "UP" control to the gear and stop the hoist operation. Operation can be reinitiated only by means of the "DOWN" control. The limit units 18 further include an overload switch, which is normally closed and interrupts the electrical current to the gear drive motor only in the event the interlocking limit switch does not operate, thus tending to overload the motor. There are, in other words, double safety devices. Each limit position unit 18, further, is provided with a slackline switch 19, which abuts the line and interrupts the current to the gear drive motor 11*a* when tension on either line drops and the line is slackened.

An elementary schematic diagram including certain portions of the electrical power circuit 11*b* is shown in FIG. 6 to illustrate a possible interconnection of the electrical operating parts. It should be understood, however, that this schematic is provided for purposes of basic description only, and it is not intended for it to be a complete operating circuit with all circuit elements. Such a complete circuit may be provided in accordance with conventional electrical engineering principles, and so the abbreviated circuit is provided to simplify the description. The voltage is supplied in the illustration in the power circuit between lines L1 and L2. For this purpose, the circuit may be single phase; 60 Hertz alternating current of nominal 115 or 230 volts. The circuit could also be direct current powered, and the principles could apply to a three phase circuit as well. The illustrated control 12 includes a normally-closed "STOP" switch, a normally-open, momentary contact "UP" switch with parallel holding contacts, and a normally-open, momentary contact "DOWN" switch with parallel holding contacts. The limit position units 18 include normally-closed contacts LS of a limit switch and normally-closed contacts OL of an overload switch. The illustrated slackline switch 19 includes a first set of normally-open contacts SS1 and a second set of normally-open contacts SS2, both sets being closed when the respective line 7 or 8 is taut. In this connection, there is provided a limit switch unit 18 and a slackline switch 19 at each side of the door, one receiving line 7 and the other receiving line 8. The drive motor 11*a* for description purposes is shown having an "UP" coil and a "DOWN" coil. Depending on the particular motor and type of voltage used, the circuit may be arranged to reverse the current applied to the same coil for reversal of motor rotation. While the limit switch 18 has been mentioned only in connection with the upper limit of the door position, it will be appreciated that the slack-switch 9 will function as a limit for the lower door position.

Because of the self-locking property of the gear 11, the door leaf 1 can be stopped in any position with respect to its vertical movement. When during the lifting or lowering movement the door leaf for some reason should start collapsing, a collapse protection device in the form of a release and lock device 20 is automatically actuated which safely locks or makes fast the door leaf against movement relative to the guide bars 4 and holds the door leaf safely locked to the guide bars until it is subjected to an upward force of a predetermined amount through the lines 7 and 8.

Figure 4:
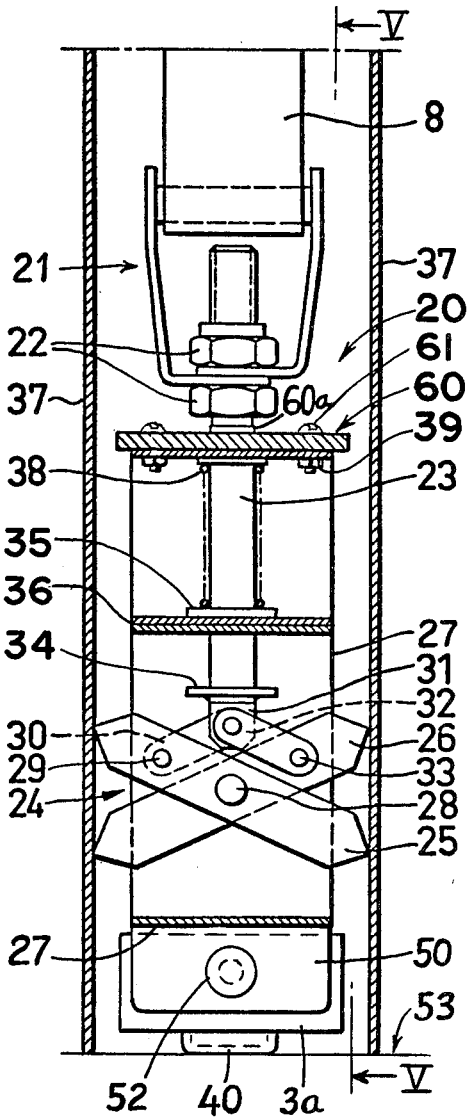
FIG. 4 is a front sectional view of a portion for the door structure taken along the line IV—IV of FIG. 3 in the direction of the arrows and illustrating the release and lock device according to the invention.
Figure 5:
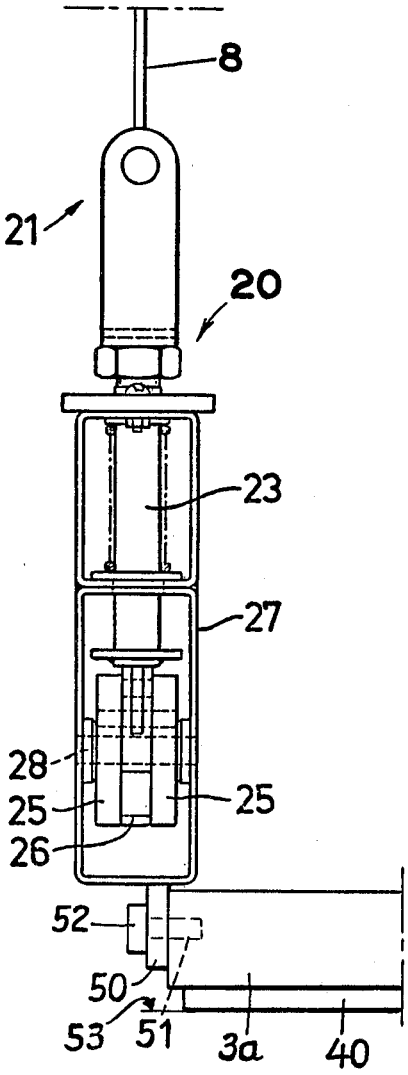
FIG. 5 is a side view of the device taken along the line V—V of FIG. 4 in the direction of the arrows.

Such a collapse protection device 20 is provided between the respective lines 7, 8 and each corresponding end of the lower cross-member 3*a* of the door leaf. As shown in FIGS. 4 and 5, the device 20 includes a holder 21 for the line which by means of nuts 22 is adjustably attached to a vertical rod 23. A suitable bushing 60*a* is contained in a plate 60 which is fastened by means of bolts 61 to the housing 27. The rod 23 is slidably received in the bushing 60*a*. The device 20 further includes a locking mechanism generally designated by 24, which comprises a plurality of flat lever members or dogs 25 and 26 arranged crosswise and having more or less pointed ends. These dogs are supported pivotally on a common shaft 28 located in a housing 27. For purposes of description, only one end of cross-member 3*a* is shown in FIG. 5, but it will be understood that the other end is similarly connected. A flange 50 is suitably attached to the underside of the housing 27. The flange contains a clearance hole through which a suitable fastener, such as a bolt 51 having a head 52, connects the flange to the end of the cross-member 3*a*. In the embodiment shown which comprises three such dogs, two parallel dogs designated by 25 are interconnected by a pin 29 and pivotally connected to the lower portion 31 of the vertical rod by a link 30 supported on the pin. The third dog is designated 26 and is located between and in cross relation to the dogs 25 and is pivotally connected to the lower portion of the vertical rod by a link 32 connected to the dog 26 by a pin 33.

The vertical rod 23 is disposed movably in the housing 27 and is provided with stop discs 34, 35 located in spaced relationship on both sides of a partition wall in the housing. The discs limit the rod movement relative to the housing. The housing 27 has a width slightly smaller than the distance between the inwardly directed lateral flanges 37 of the guide bar (see FIG. 3) and is entirely exposed to these lateral flanges. The dogs 25, 26 are arranged to engage and apply a binding locking force against these opposing flanges 37 in order to stop and lock the door leaf 1 against movement relative to the guide bar 4 as soon as the load on the line drops below a predetermined value, which value is determined by a spring 38 clamped between the upper stop disc 35 of the vertical rod and the inside of an upper surface 39 of the housing.

At normal load on the lines 7 and 8, which load is substantially the dead weight of the door leaf, the vertical rod 23 abuts the partition wall 36 of the housing with its lower stop disc after overcoming the force on the spring 38 and compressing it. At this position the dogs 25, 26 are pivoted to be located entirely within the housing 27, and in this condition the door leaf is released and can be lifted and lowered without being obstructed by the locking devices 20. If one of the lines 7 or 8 breaks, however, or if the load on a line for some other reason drops below the force applied by the compressed spring 38 of the associated locking device 20, the spring moves the rod 23 relative to the housing 27. Thereby the dogs 25, 26 rapidly are pivoted out of the housing 27 into engagement with the lateral flanges 37 of the associated guide bar and thereby lock the lower cross-member 3*a* of the door leaf against movement relative to the guide bar. At the same time as the load on the rope drops or ceases entirely, the slackline switch 19 is actuated to interrupt the electrical current to the drive motor 11*a* and stop the hoist means 6.

The collapse protection device 20 acts in locking position also as a lock, which renders lifting and lowering of the door leaf 1 impossible, because either an upwardly or a downwardly directed force on the lower cross-member 3*a* of the door leaf tends to cause the dogs 25, 26 to additionally pivot outwardly, which action secures or makes fast the position of the cross-member 3*a* with respect to the guide bar 4. It can be seen that this action involves both ends of each dog in the assembly acting cooperatively to tighten the friction grip of the dog ends against the corresponding adjacent surfaces of the opposing flanges 37. If the flanges were further lined with a compressible material, such as wood, the dogs would tend to "dig in" to the material to further secure the position. Such lining is not needed, however, for satisfactory operation of the device in accordance with this invention. It does serve to further illustrate the action of the dogs, however.

This stopping and locking effect can be released only by an upwardly directed force on the lines 7 and 8 which in turn acts upon the vertical rod 23 to overcome the spring 38 force. Such upwardly directed force may be the stretching of the line by means of the hoist means 6. Even when the door is entirely closed, i.e., when the lowermost cross-member 3*a* of the door leaf with its lower surface, which may be additionally provided with a rubber moulding 40 to seal the door and add further protection, entirely abuts the lower horizontal defining surface of the door opening, such as a floor 53, the collapse protection or release and lock devices will operate to effectively lock the door. The door thereby cannot be opened unless the hoist means 6 is operated.

Each device 20, thus, becomes operative and locks the door leaf as soon as the line load is less than the force applied by the spring 38. By braking or lifting the lower cross-member of the door leaf, for example manually, it is thus possible at any desired time to lock the door leaf in any desired open position. There is no need to first provide, and in use hunt for, predetermined fixed positions of engagement of the cross-member 3*a* with the guide bars 4.

The present invention is not restricted to the embodiment described above and shown in the drawings, but can be altered and modified in many different ways within the scope of the invention as set forth in the attached claims. The device according to the invention, thus, also can be applied in connection with doors other than here described if they can be opened and closed by vertical movement along at least a portion of the vertical defining surfaces of the door opening.

What is claimed is:

1. A release and lock mechanism for use in a door having a leaf of flexible material and held in suspension for raising and lowering within an opening by at two lines attached one to each end of the lower portion of the door leaf and connected to a hoist means, the ends of the leaf being guided in substantially U-shaped guide bars having lateral flanges, the guide bars being attached to the vertical defining surfaces of the door opening and the two lines extending to the hoist means each within a guide bar, said release and lock mechanism being connected intermediate the end of each line and the respective end of the lower portion of the door leaf and comprising: a vertically movable rod for connection to a respective line, a spring disposed in surrounding relation to said rod, and a locking mechanism in operable connection with said rod and actuated by said spring to a locking position in response to a predetermined decrease in load on the respective line, said mechanism being released from said locking position when the load on the respective line overcomes the force of the spring, said locking mechanism including at least two dogs pivoted in crosswise arrangement on a common shaft for disposition intermediate the lateral flanges of the associated guide bar and connected by links to the rod in movable relation to said shaft, said locking mechanism upon actuation providing an opposing outward expansion of both ends of each dog for creating two vertically spaced apart points of frictional engagement with each of the lateral flanges of the associated guide bars at any vertical position of the lower portion of the door leaf relative to the guide bars when the door leaf is mounted therein, said outward expansion of both ends of each dog thereby causing a fast condition of the door leaf against movement either up or down relative to the guide bars.

2. A door assembly dependent on a supporting structure for holding the door in suspension for raising and lowering within an opening having vertical defining surfaces, said door assembly comprising:

a door having a leaf of flexible material;

two lines attached one to each end of the lower portion of the door leaf;

hoist means having connections for a power circuit and receiving the two lines for the winding and unwinding of same;

a pair of U-shaped guide bars having lateral flanges for attachment to the vertical defining surfaces of the door opening, the guide bars receiving the ends of the door leaf and guiding the same when so attached and the door is held in suspension, said two lines extending to the hoist means each within a guide bar; and release and lock means connected intermediate the end of each line and the respective end of the lower portion of the door leaf, said release and lock means being actuated to lock the door leaf to the guide bar in response to a predetermined decrease in load on the respective line when the door is held in suspension and being released from the locking position when a predetermined load on the respective line is reinstated, each said release and lock means including a rod movable with respect to the door leaf and connected to the respective line, a spring in surrounding relation to the rod responsive to the decrease in load, and a locking mechanism in operable connection with said rod, said locking mechanism including at least two dogs pivoted in crosswise arrangement on a common shaft and disposed intermediate the lateral flanges of the associated guide bar and connected by links to the rod in movable relation to said shaft, said locking mechanism being actuated by said spring upon the respective line receiving the predetermined decrease in load and when so actuated providing an opposing outward expansion of both ends of each dog and creating two vertically spaced apart points of frictional engagement with each of the lateral flanges of the associated guide bar at any vertical position of the lower portion of the door leaf relative to the guide bars and causing thereby a fast condition of the door leaf against movement either up or down relative to the guide bars when said door and guide bars are mounted for operation, said locking mechanism releasing the fast condition only when the load on the respective line overcomes the force of said spring.

3. A door according to claim 2 wherein said lines are each drawn over a guide wheel at the upper portion of the door to a common drum in the hoist means onto and from which the lines are wound and unwound respectively, one line connected for extension over the drum and the other under the drum.

4. A door according to claim 2 or 3 further comprising electrical stop means provided in operable contact with each line and actuated also in response to the predetermined decrease in load on the respective line, the stop means when so actuated stopping operation of the hoist by interrupting the hoist means power circuit.

5. A door according to claim 2 or 3 further comprising electrical stop means actuated when the lower portion of the door leaf reaches a predetermined upper limit position or a predetermined lower limit position when said door is suspended for operation, said stop means when so actuated stopping operation of the hoist by interrupting the hoist means power circuit, rotating the drive motor in the given direction, the hoist means being thereafter reactivated only by electrically energizing the control circuit for reversing the direction of drive motor rotation.

* * * * *

UNITED STATES PATENT AND TRADEMARK OFFICE

CERTIFICATE OF CORRECTION

PATENT NO. : 4,368,770

DATED : January 18, 1983

INVENTOR(S) : Torbjorn Ulfhielm

It is certified that error appears in the above-identified patent and that said Letters Patent is hereby corrected as shown below:

Column 1, line 2, after "1979," insert --now abandoned,--.

Column 1, line 38, after "portion" delete "for" and insert --of--.

Column 3, line 1, after "phase" delete ";" and insert -- , --.

Column 5, line 26, after "at" insert --least--.

Signed and Sealed this

Twenty-sixth Day of April 1983

[SEAL]

*Attest:*

GERALD J. MOSSINGHOFF

*Attesting Officer*

*Commissioner of Patents and Trademarks*